US012420159B1

(12) United States Patent
Zuo

(10) Patent No.: US 12,420,159 B1
(45) Date of Patent: Sep. 23, 2025

(54) MULTIFUNCTIONAL HANGER OF ADJUSTABLE SWIMMING TRAINING MACHINE

(71) Applicant: Xiangqian Zuo, Shenzhen (CN)

(72) Inventor: Xiangqian Zuo, Shenzhen (CN)

( * ) Notice: Subject to any disclaimer, the term of this patent is extended or adjusted under 35 U.S.C. 154(b) by 0 days.

(21) Appl. No.: 19/220,511

(22) Filed: May 28, 2025

(30) Foreign Application Priority Data

May 16, 2025 (CN) ..... 202520961585.7

(51) Int. Cl.
*A63B 69/12* (2006.01)

(52) U.S. Cl.
CPC ..... *A63B 69/12* (2013.01)

(58) Field of Classification Search
CPC ..... A63B 69/12; A63B 69/125; A63B 69/14
USPC ..... 248/229.1
See application file for complete search history.

(56) References Cited

U.S. PATENT DOCUMENTS 5,597,288 A * 1/1997 Hatanaka ..... E04H 4/14 416/247 R
7,526,820 B2 * 5/2009 Murdock ..... E04H 4/144 4/492
11,511,177 B2 * 11/2022 Zeidman ..... A63B 69/12
11,583,743 B2 * 2/2023 Huang ..... A63B 69/125
2005/0184207 A1 * 8/2005 Bertram, III ..... F21V 21/096 248/229.1
2010/0122961 A1 5/2010 Moreau
2015/0295397 A1 * 10/2015 Lin ..... E04H 4/0006 4/491
2015/0321333 A1 11/2015 Ou
2019/0301667 A1 10/2019 Sokoly
2020/0269114 A1 * 8/2020 Huang ..... A63B 69/125
2021/0129002 A1 * 5/2021 Huang ..... A63B 69/125
2022/0001260 A1 * 1/2022 Zeidman ..... A63B 69/12
2024/0209646 A1 * 6/2024 Yao ..... E04H 15/02

* cited by examiner

*Primary Examiner* — Muhammad Ijaz
(74) *Attorney, Agent, or Firm* — Hemisphere Law, PLLC; Zhigang Ma

(57) ABSTRACT

A multifunctional hanger of an adjustable swimming training machine is provided, which relates to the technical field of a fixing apparatus of a swimming pool training device. The multifunctional hanger includes a U-shaped hanger, an adjustable cross bar and at least two fixing components. A plurality of limiting holes are arranged at equal intervals along an axial direction of the vertical part to be fixed with the swimming training machine through locking screws; the bent part is integrally connected to two vertical parts; the adjustable cross bar is transversely connected to the bent part. Through a modular adjustable structure, this solution solves an adaptation problem of different swimming pool environments, and achieves rapid installation and precise adjustment at the same time.

8 Claims, 7 Drawing Sheets

MULTIFUNCTIONAL HANGER OF ADJUSTABLE SWIMMING TRAINING MACHINE

TECHNICAL FIELD

The present disclosure relates to the technical field of a fixing apparatus of a swimming pool training device, and in particular to the technical field of a multifunctional hanger of an adjustable swimming training machine.

BACKGROUND

A swimming training machine is a fitness device that simulates swimming, which is suitable for swimmers, athletes or ordinary users to carry out swimming training on land, and can help users to improve their skills, strengthen their muscle strength, and enhance their cardiopulmonary endurance, while avoiding the limitations of underwater training (such as venues, water temperature, weather, etc.). The swimming training machine needs to be provided with a hanger device. The existing patents disclose the following technologies.

The Patent Publication No. CN216755300U entitled "ACCESSORY HANGER AND TRAINING FRAME" discloses the following contents. A fixing plate and a plurality of hooks are included. The fixing plate includes a first connecting part, a second connecting part and a third connecting part which are arranged in sequence. The first connecting part is provided with a plurality of through holes. The first connecting part and the third connecting part are connected to the second connecting part, respectively. The plurality of hooks are fixedly connected to the third connecting part, respectively. A plurality of hooks are arranged on the third connecting part at equal intervals along a horizontal line. The hook includes a fourth connecting part and a bent part. The fourth connecting part is fixedly connected to the third connecting part. One end, far away from the fourth connecting part, of the bent part is bent towards the first connecting part. A training frame includes a frame body. The frame body includes a top frame and a bottom frame. The frame body is provided with a training space for users to train. One side that is of the top frame and that faces the bottom frame is provided with an accessory hanger, and the hook faces the training space. The accessory can be hung on the accessory hanger, which is convenient for users to take the accessory.

The Patent Publication No. CN211796272U entitled "SWIMMING POOL CLEANER HANGER" discloses the following contents. A base, a bracket and a top skin are included. The base includes a chassis, a water receiving tray and a traveling wheel. The water receiving tray is detachably and horizontally arranged on the chassis. The traveling wheel is arranged at the bottom of the chassis. The bracket includes vertical rods, rotating rods, a cantilever and cleaning tool suspension components. The two vertical rods are vertically arranged on two sides of the chassis. The two rotating rods are rotatably arranged on the two vertical rods, respectively. Two ends of the cantilever are rotatably connected to free ends of the two rotating rods, respectively. More than two cleaning tool suspension components are arranged on the cantilever at intervals. The top skin is arranged at the top of the vertical rod. The water receiving tray, the cantilever and the top skin are arranged in sequence in a vertical direction. The present disclosure uses a movable cleaning tool hanger, which is convenient for storage and transportation of a cleaning tool and can be taken and used at any time, thus greatly improving cleaning efficiency of the swimming pool.

The above-mentioned patents and the conventional swimming training machines are of a fixed design, which need to be fixed to a sinking part of a swimming pool and cannot adapt to swimming pools with different depths and widths.

SUMMARY

The objective of the present disclosure is to solve the above technical problems. The present disclosure provides a multifunctional hanger of an adjustable swimming training machine.

In order to achieve the above objective, the present disclosure specifically uses the following technical solution.

The present disclosure provides a multifunctional hanger of an adjustable swimming training machine, including:

- a U-shaped hanger, where the U-shaped hanger consists of two bent rods arranged in parallel, and each of the bent rods includes a vertical part and a bent part; the vertical part is of a tubular structure, a plurality of limiting holes are arranged at equal intervals along an axial direction of the vertical part to be fixed with the swimming training machine through locking screws; the bent part is integrally connected to two vertical parts to form a bent U-shaped structure with a downward opening;
- an adjustable cross bar, where the adjustable cross bar is transversely connected to the bent part, the length of the adjustable cross bar is adjustable to adapt to frame swimming pools with different widths, and the adjustable cross bar is detachably connected to the bent part through a fastener;
- at least two fixing components, where each of the fixing components includes a clamp and an L-shaped fixing bracket; the clamp is configured to clamp the vertical rod of the frame swimming pool; and the L-shaped fixing bracket detachably connects the clamp with an end of the adjustable cross bar to fix the adjustable cross bar on the vertical bar of the frame swimming pool.

Specifically, an inner side of a bent part of the U-shaped hanger can be attached to the frame of the frame swimming pool. The swimming training machine is mounted on the U-shaped-like hanger through the limiting hole to achieve height adjustment. Through a modular adjustable structure, this solution solves an adaptation problem of different swimming pool environments (such as an aboveground frame swimming pool and a fixed swimming pool), and achieves rapid installation and precise adjustment at the same time.

The multifunctional hanger designed in this solution can also be used in a frame swimming pool, an aboveground swimming pool, a fixed swimming pool and other types of swimming pools, whose height can be adjusted to meet the training needs of different water levels. The multifunctional hanger has the advantages of stability and safety. The design of double fixation (U-shaped-like hanger+clamp) prevents the swimming training machine from shaking or falling off. This device can be quickly assembled and disassembled without professional tools, and can be manually operated, which is convenient for migration and storage of the device.

In one embodiment, each of the bent parts includes a connecting cross bar and two inclined rods arranged on two ends of the connecting cross bar, respectively, axes of the two inclined rods are parallel to each other, an axial direction of each of the inclined rods is orthogonal to an axis of the connecting cross bar, and a tail end of each of the inclined rods is connected to the corresponding vertical part.

In one embodiment, a first arc-shaped transition is arranged at a joint between each of the inclined rods and the connecting cross bar, and a second arc-shaped transition is arranged at a joint between the tail end of each of the inclined rods and the corresponding vertical part.

In one embodiment, an included angle between the axis of the inclined rod and the axis of the vertical part ranges from 25 degrees to 45 degrees.

In one embodiment, the included angle between the axis of the inclined rod and the axis of the vertical part is 30 degrees.

In one embodiment, one end of the L-shaped fixing bracket is clamped on the vertical rod of the frame swimming pool through the clamp, and the other end of the L-shaped fixing bracket is detachably connected to the end of the adjustable cross bar through a fastener.

Specifically, the length and the number of stainless steel cross bars are selected as required. Width adjustment can be achieved by adjusting the mounting positions of the L-shaped fixing bracket and the fastener. On the one hand, the height of the swimming training machine can be controlled by limiting holes and locking screws, and on the other hand, can be adjusted by adjusting the position of the clamp mounted on the vertical rod outside the frame swimming pool.

In one embodiment, the adjustable cross bar includes a plurality of stainless steel cross bars which are detachably connected.

In one embodiment, the two vertical parts are both vertical rods, center lines of the plurality of limiting holes located on the same vertical rod are all orthogonal to the axis of the corresponding vertical rod, and center lines of all of the limiting holes located on the same vertical rod are located on the same plane.

The present disclosure has the following beneficial effects.

The multifunctional hanger designed in this solution can also be used in a frame swimming pool, an aboveground swimming pool, a fixed swimming pool and other types of swimming pools, whose height can be adjusted to meet the training needs of different water levels. The multifunctional hanger has the advantages of stability and safety. The design of double fixation (U-shaped-like hanger+clamp) prevents the swimming training machine from shaking or falling off. This device can be quickly assembled and disassembled without professional tools, and can be manually operated, which is convenient for migration and storage of the device.

BRIEF DESCRIPTION OF THE DRAWINGS

In order to explain the technical solution of the embodiment of the present disclosure more clearly, the drawings required for the embodiments will be briefly introduced hereinafter. It should be understood that the following drawings only show some embodiments of the present disclosure, which therefore should not be regarded as limiting the scope. For those skilled in the art, other related drawings can be obtained according to these drawings without paying creative labor.

Figure 1:
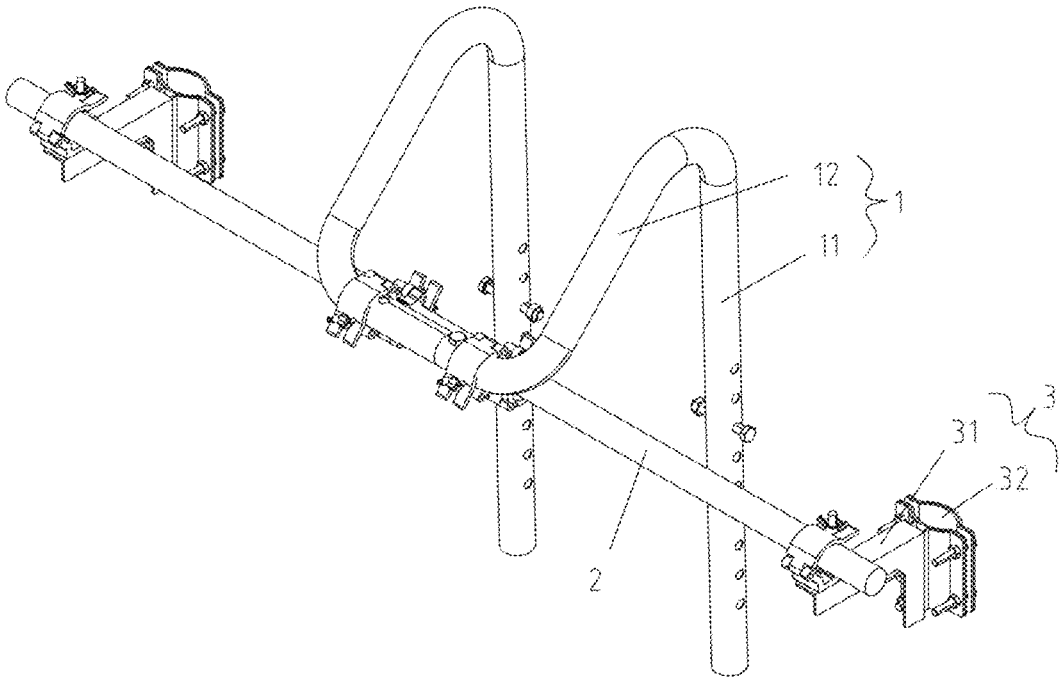
FIG. 1 is a schematic structural diagram of the present disclosure.

Reference numerals: 1. U-shaped hanger; 2. Adjustable cross bar; 3. Fixing component; 11. Vertical part; 12. Bent part; 31. L-shaped fixing bracket; 32. Clamp; 4. Swimming training machine.

DETAILED DESCRIPTION OF THE EMBODIMENTS

In order to make the technical problem, the technical solution and the technical effect of the present disclosure clearer, the technical solution in the embodiment of the present disclosure will be described clearly and completely with reference to the drawings in the embodiment of the present disclosure. Obviously, the described embodiments are some of the embodiments of the present disclosure, rather than all of the embodiments. The components of the embodiments of the present disclosure generally described and shown in the drawings herein can be arranged and designed in various different configurations.

Therefore, the following detailed description of the embodiments of the present disclosure provided in the drawings is not intended to limit the claimed scope of the present disclosure, but only represents selected embodiments of the present disclosure. Based on the embodiment of the present disclosure, all other embodiments obtained by those skilled in the art without paying creative labor belong to the protection scope of the present disclosure.

It should be noted that similar reference numerals and letters indicate similar items in the following drawings. Therefore, once an item is defined in one drawing, the item does not need to be further defined and explained in subsequent drawings. In addition, the terms "first", "second" and the like are only used to distinguish descriptions, and cannot be understood as indicating or implying relative importance.

In the description of the embodiments of the present disclosure, it should be noted that the orientation or position relationship indicated by the terms "inside", "outside" and "on" is the orientation or position relationship shown based on the drawings, or is the orientation or position relationship that the product of the present disclosure is usually placed in use, which is only for the convenience of describing the present disclosure and simplifying the description, but does not to indicate or imply that the apparatus or element referred to must have a specific orientation, be constructed and operated in a specific orientation, and therefore, cannot be construed as a limitation to the present disclosure.

Embodiment 1

Figure 2:
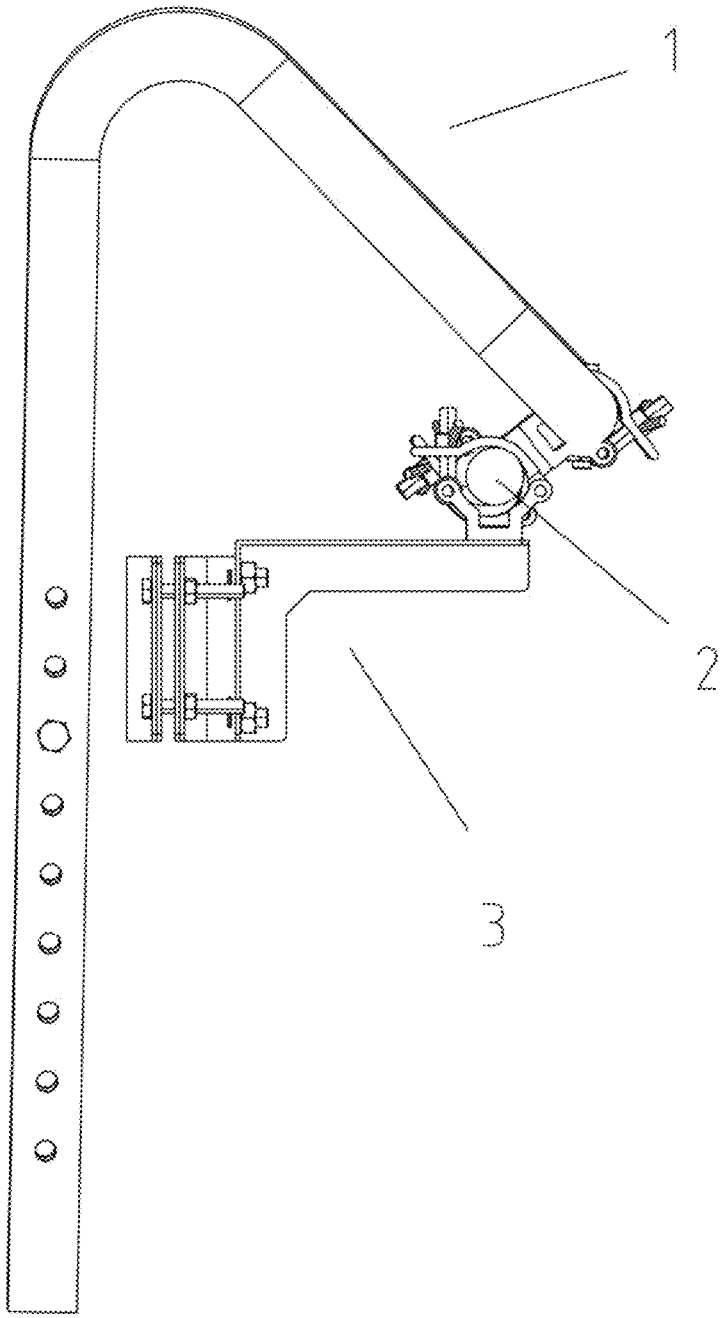
FIG. 2 is a side view of FIG. 1.
Figure 3:
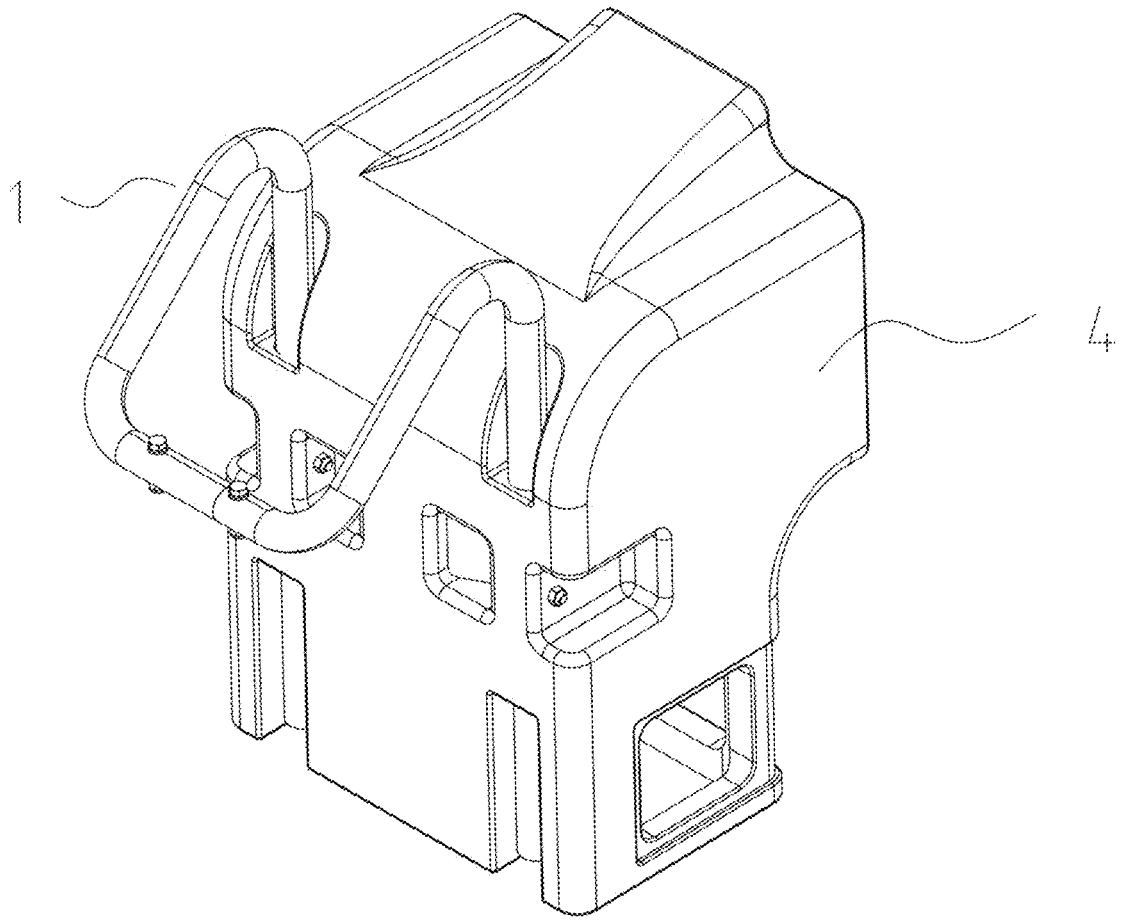
FIG. 3 is a schematic structural diagram of an adjustable swimming training machine mounted on FIG. 1.
Figure 4:
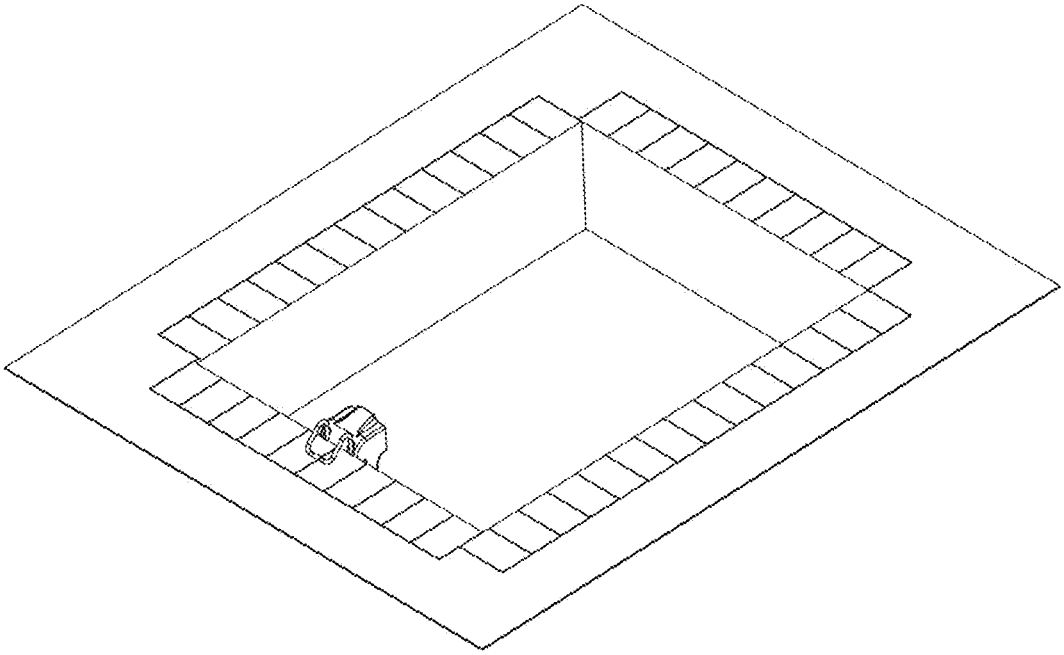
FIG. 4 is a schematic structural diagram of FIG. 3 mounted at an edge of an underground swimming pool.
Figure 5:
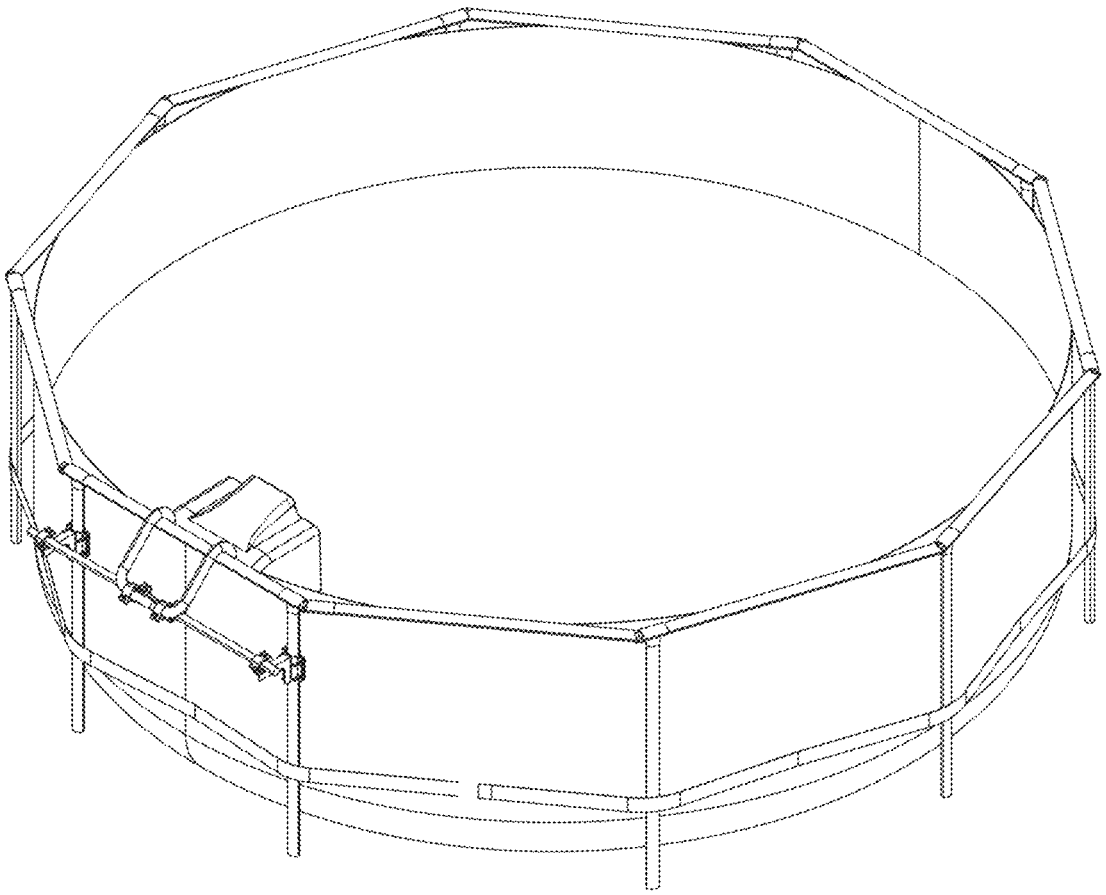
FIG. 5 is a schematic structural diagram of FIG. 3 mounted at an edge of an aboveground swimming pool.
Figure 6:
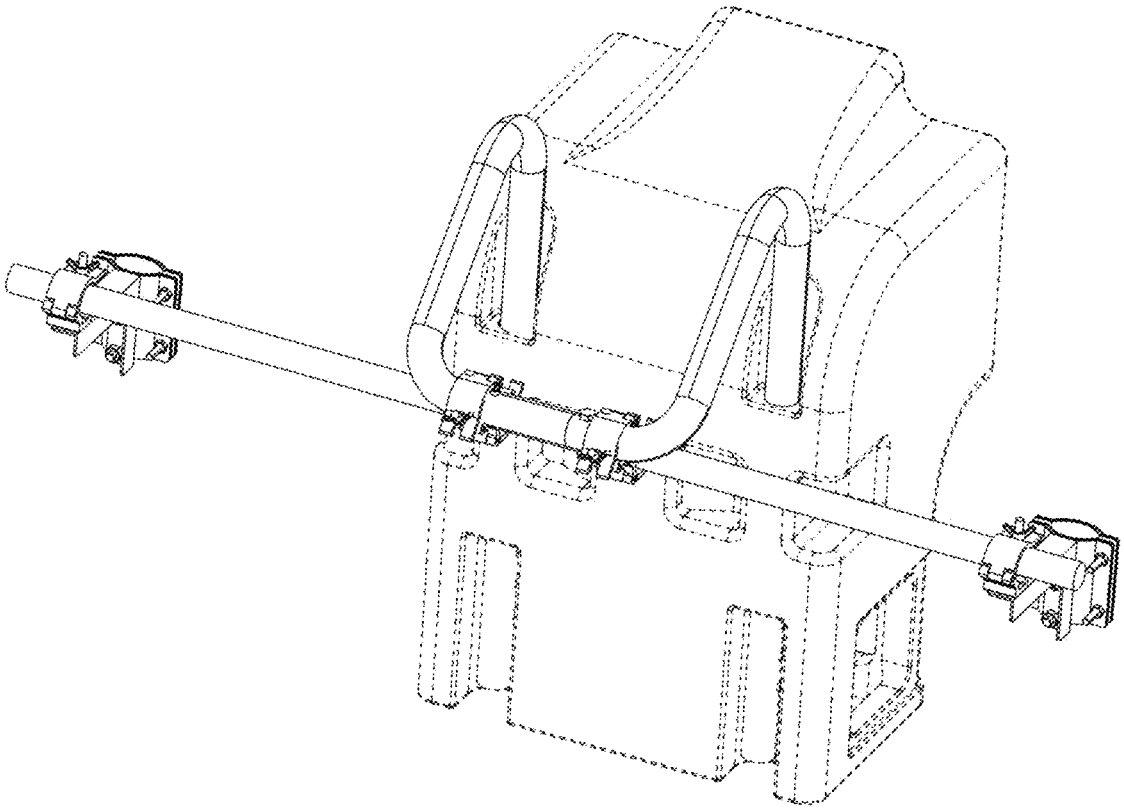
FIG. 6 is a partial schematic structural diagram of FIG. 5.
Figure 7:
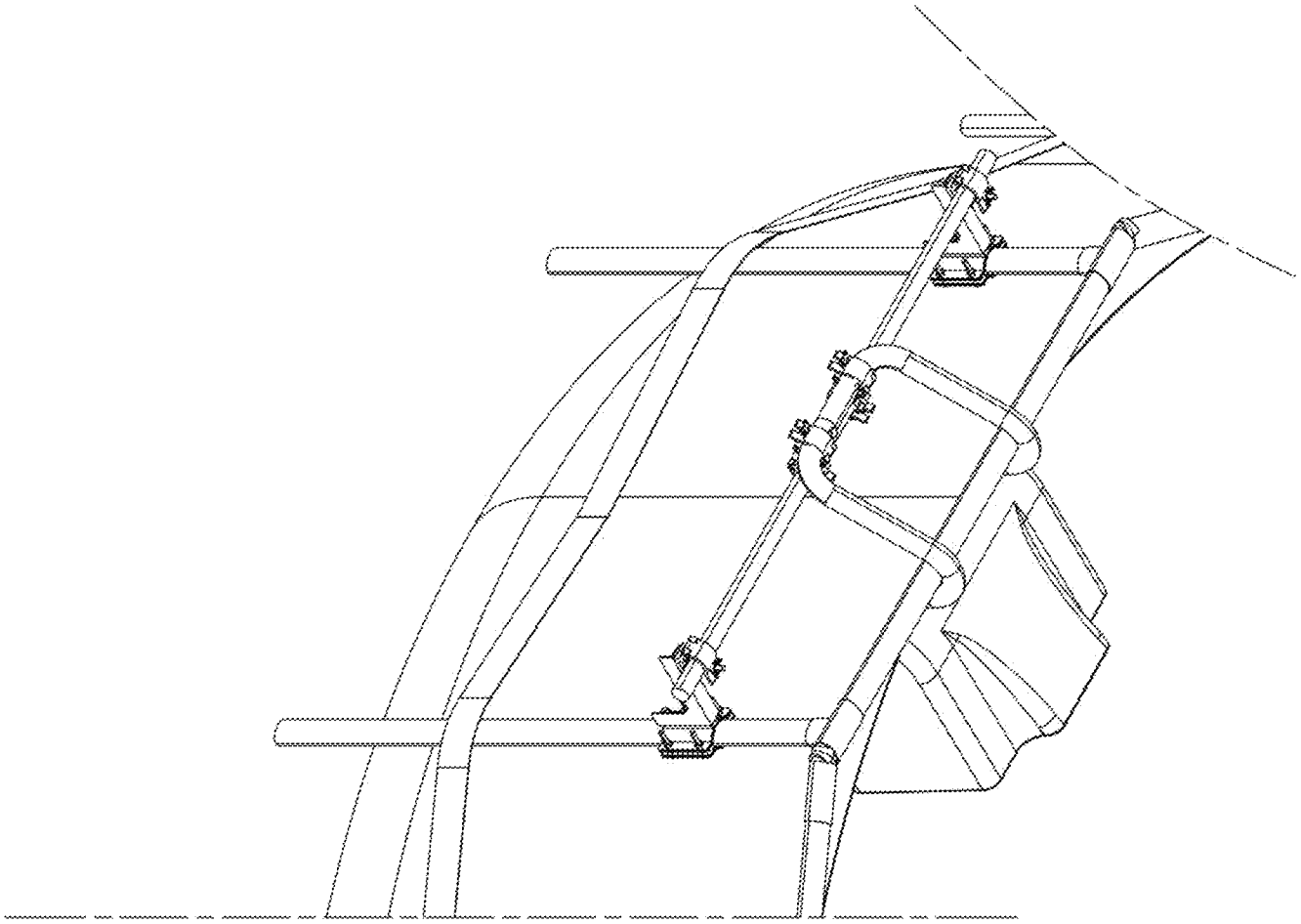
FIG. 7 is a partial enlarged view of FIG. 5.

As shown in FIG. 1 to FIG. 7, this embodiment provides a multifunctional hanger of an adjustable swimming training machine 4, including:

a U-shaped hanger 1, where the U-shaped hanger consists of two bent rods arranged in parallel, and each of the bent rods includes a vertical part 11 and a bent part 12; the vertical part 11 is of a tubular structure, a plurality of limiting holes are arranged at equal intervals along an axial direction of the vertical part to be fixed with the swimming training machine 4 through locking screws;

the bent part 12 is integrally connected to two vertical parts 11 to form a bent U-shaped structure with a downward opening;

an adjustable cross bar 2, where the adjustable cross bar is transversely connected to the bent part 12, the length of the adjustable cross bar is adjustable to adapt to frame swimming pools with different widths, and the adjustable cross bar is detachably connected to the bent part 12 through a fastener;

at least two fixing components 3, where each of the fixing components 3 includes a clamp 32 and an L-shaped fixing bracket 31; the clamp 32 is configured to clamp the vertical rod of the frame swimming pool; and the L-shaped fixing bracket 31 detachably connects the clamp 32 with an end of the adjustable cross bar 2 to fix the adjustable cross bar 2 on the vertical bar of the frame swimming pool.

Specifically, an inner side of a bent part of the U-shaped hanger 1 can be attached to the frame of the frame swimming pool. The swimming training machine 4 is mounted on the U-shaped-like hanger through the limiting hole to achieve height adjustment. Through a modular adjustable structure, this solution solves an adaptation problem of different swimming pool environments (such as an aboveground frame swimming pool and a fixed swimming pool), and achieves rapid installation and precise adjustment at the same time.

The multifunctional hanger designed in this solution can also be used in a frame swimming pool, an aboveground swimming pool, a fixed swimming pool and other types of swimming pools, whose height can be adjusted to meet the training needs of different water levels. The multifunctional hanger has the advantages of stability and safety. The design of double fixation (U-shaped-like hanger+clamp 32) prevents the swimming training machine 4 from shaking or falling off. This device can be quickly assembled and disassembled without professional tools, and can be manually operated, which is convenient for migration and storage of the device.

Embodiment 2

This embodiment is further optimized on the basis of Embodiment 1, which is specifically as follows.

Each of the bent parts 12 includes a connecting cross bar and two inclined rods arranged on two ends of the connecting cross bar, respectively, axes of the two inclined rods are parallel to each other, an axial direction of each of the inclined rods is orthogonal to an axis of the connecting cross bar, and a tail end of each of the inclined rods is connected to the corresponding vertical part 11.

A first arc-shaped transition is arranged at a joint between each of the inclined rods and the connecting cross bar, and a second arc-shaped transition is arranged at a joint between the tail end of each of the inclined rods and the corresponding vertical part 11.

An included angle between the axis of the inclined rod and the axis of the vertical part 11 ranges from 25 degrees to 45 degrees.

Embodiment 3

This embodiment is further optimized on the basis of Embodiment 2, which is specifically as follows.

The included angle between the axis of the inclined rod and the axis of the vertical part 11 is 30 degrees.

One end of the L-shaped fixing bracket 31 is clamped on the vertical rod of the frame swimming pool through the clamp 32, and the other end of the L-shaped fixing bracket 31 is detachably connected to the end of the adjustable cross bar 2 through a fastener.

Specifically, the length and the number of stainless steel cross bars are selected as required. Width adjustment can be achieved by adjusting the mounting positions of the L-shaped fixing bracket 31 and the fastener. On the one hand, the height of the swimming training machine 4 can be controlled by limiting holes and locking screws, and on the other hand, can be adjusted by adjusting the position of the clamp 32 mounted on the vertical rod outside the frame swimming pool.

Embodiment 4

This embodiment is further optimized on the basis of Embodiment 2, which is specifically as follows.

The adjustable cross bar 2 includes a plurality of stainless steel cross bars which are detachably connected.

The two vertical parts 11 are both vertical rods, center lines of the plurality of limiting holes located on the same vertical rod are all orthogonal to the axis of the corresponding vertical rod, and center lines of all of the limiting holes located on the same vertical rod are located on the same plane.

Working Principle:

Step 1, the U-shaped-like hanger is snapped into the swimming pool trainer, and the swimming training machine 4 is selected to be mounted at an appropriate position on the U-shaped-like hanger according to the depth of the water level.

Step 2, two fixing components 3 consisting of a clamp 32 and an L-shaped fixing bracket 31 are mounted on two vertical rods clamping the frame swimming pool with adjustable height.

Step 3, the adjustable cross bar 2 selects the required number of stainless steel cross bars according to the distance between the two vertical bars, all the stainless steel cross bars are connected to form the adjustable cross bar 2, and two ends of the adjustable cross bar 2 are mounted on two fixing components 3 through an aluminum alloy fastener.

Step 4, the bent part of the U-shaped-like hanger is snapped into the tubular frame of the swimming pool, and is detachably connected to the adjustable cross bar 2 through an aluminum alloy fastener.

Step 5, when the hanger mounted in the aboveground frame swimming pool, the height is adjusted by adjusting the position of the swimming training machine 4 mounted on the U-shaped-like hanger and the position of the fixing component 3 mounted on the vertical rod, so as to complete the whole structure. The height of the aboveground frame swimming pool can be adjusted by selecting different limiting holes on the vertical part 11 of the U-shaped hanger 1 and adjusting the position of the adjusting component 3 mounted on the vertical pole of the swimming pool. When the hanger is mounted in an underground swimming pool, the ground first is marked on according to the position of the U-shaped hanger 1, and then a hole is drilled at the marked position, and the U-shaped hanger is fixed on the ground beside the swimming pool with an expansion bolt. The height of the underground swimming pool is adjusted by selecting different limit holes on the vertical part 11 of the U-shaped hanger 1.

What is claimed is:

1. A multifunctional hanger of an adjustable swimming training machine, comprising:

a U-shaped hanger (1), wherein the U-shaped hanger consists of two bent rods arranged in parallel, and each of the bent rods comprises a vertical part (11) and a bent part (12); the vertical part (11) is of a tubular structure, a plurality of limiting holes are arranged at equal intervals along an axial direction of the vertical part to be fixed with the swimming training machine (4) through locking screws; the bent part (12) is integrally connected to two vertical parts (11) to form a bent U-shaped structure with a downward opening;

an adjustable cross bar (2), wherein the adjustable cross bar is transversely connected to the bent part (12), the length of the adjustable cross bar is adjustable to adapt to frame swimming pools with different widths, and the adjustable cross bar is detachably connected to the bent part (12) through a fastener;

at least two fixing components (3), wherein each of the fixing components (3) comprises a clamp (32) and an L-shaped fixing bracket (31); the clamp (32) is configured to clamp the vertical rod of the frame swimming pool; and the L-shaped fixing bracket (31) detachably connects the clamp (32) with an end of the adjustable cross bar (2) to fix the adjustable cross bar (2) on the vertical bar of the frame swimming pool.

2. The multifunctional hanger of the adjustable swimming training machine according to claim 1, wherein each of the bent parts (12) comprises a connecting cross bar and two inclined rods arranged on two ends of the connecting cross bar, respectively, axes of the two inclined rods are parallel to each other, an axial direction of each of the inclined rods is orthogonal to an axis of the connecting cross bar, and a tail end of each of the inclined rods is connected to the corresponding vertical part (11).

3. The multifunctional hanger of the adjustable swimming training machine according to claim 2, wherein a first arc-shaped transition is arranged at a joint between each of the inclined rods and the connecting cross bar, and a second arc-shaped transition is arranged at a joint between the tail end of each of the inclined rods and the corresponding vertical part (11).

4. The multifunctional hanger of the adjustable swimming training machine according to claim 2, wherein an included angle between the axis of the inclined rod and the axis of the vertical part (11) ranges from 25 degrees to 45 degrees.

5. The multifunctional hanger of the adjustable swimming training machine according to claim 4, wherein the included angle between the axis of the inclined rod and the axis of the vertical part (11) is 30 degrees.

6. The multifunctional hanger of the adjustable swimming training machine according to claim 1, wherein one end of the L-shaped fixing bracket (31) is clamped on the vertical rod of the frame swimming pool through the clamp (32), and the other end of the L-shaped fixing bracket (31) is detachably connected to the end of the adjustable cross bar (2) through a fastener.

7. The multifunctional hanger of the adjustable swimming training machine according to claim 1, wherein the adjustable cross bar (2) comprises a plurality of stainless steel cross bars which are detachably connected.

8. The multifunctional hanger of the adjustable swimming training machine according to claim 1, wherein the two vertical parts (11) are both vertical rods, center lines of the plurality of limiting holes located on the same vertical rod are all orthogonal to the axis of the corresponding vertical rod, and center lines of all of the limiting holes located on the same vertical rod are located on the same plane.

* * * * *